United States Patent [19]

Kubiatowicz

[11] 4,152,863

[45] May 8, 1979

[54] POPPER TOY

[75] Inventor: James F. Kubiatowicz, Minneapolis, Minn.

[73] Assignee: Custom Concepts, Incorporated, Minneapolis, Minn.

[21] Appl. No.: 758,787

[22] Filed: Jan. 12, 1977

[51] Int. Cl.[2] ..... A63H 33/00

[52] U.S. Cl. ..... 46/1 R; 46/74 D

[58] Field of Search ..... 46/1 R, 129, 74 D; 273/106.5 A, 126 R

[56] References Cited

U.S. PATENT DOCUMENTS

| | | | |
|---|---|---|---|
| 1,677,122 | 7/1928 | Johnson | 46/129 |
| 1,962,927 | 6/1934 | De Bats | 46/1 R |
| 2,153,957 | 4/1939 | Davis | 46/1 R |
| 2,562,685 | 7/1951 | Adams | 46/1 R |
| 3,359,678 | 12/1967 | Headrick | 46/74 D |
| 3,724,122 | 4/1973 | Gillespie, Sr. | 46/74 D |

*Primary Examiner*—Louis G. Mancene
*Assistant Examiner*—Mickey Yu
*Attorney, Agent, or Firm*—William L. Huebsch

[57] ABSTRACT

A popper toy comprising a dish shaped wall of thin flexible resilient polymeric material. The popper wall has a plurality of concentric portions including outer portions providing a generally rigid support structure, and central portions providing a domed structure adapted to be deflected under moderate thumb pressure. When the domed structure is deflected a portion of its outer surface will temporarily change from convex to concave. The central domed structure will then suddenly recover its original shape a short time after the pressure is released, thereby suddenly returning the portion of its outer surface to convex so that the popper will leap into the air if its outer surface is positioned against a firm surface as the domed structure recovers.

10 Claims, 6 Drawing Figures

POPPER TOY

BACKGROUND OF THE INVENTION

This invention relates to popper toys of the type having a dish shaped wall, a portion of which may be deflected to temporarily change its outer surface from convex to concave and will then suddenly recover and return its outer surface to convex so that, if its outer surface is against a firm support surface during such recovery, the popper toy will leap into the air.

Such popper toys are known in which the wall of the popper toy is bi-metal and the change in shape of the popper is a result of thermal action. Popper toys of this type are available from Edmund Scientific Co., Barrington, New Jersey, and may be obtained with various designs and/or messages thereon for use as favors or advertising novelties.

While these popper toys may work well, their bi-metal construction and the processes that must be used to form the designs and/or messages thereon makes them more expensive than may be desired for many applications.

SUMMARY OF THE INVENTION

The present invention provides a popper toy generally of the type described which is of a substantially less expensive construction than the bi-metal variety described above, and on which designs and/or messages may be more easily and economically provided.

The dish shaped popper toy according to the present invention is formed from a sheet of flexible resilient polymeric material such as litho grade styrene polymer which may be printed by a conventional process, such as offset litho printing, before the popper toy is formed.

The formed popper toy comprises a thin generally dish shaped wall of the flexible resilient polymeric material, which wall has a normally convex outer surface, and comprises wall structure means for providing a central domed flexible structure surrounded by a generally rigid structure. The domed flexible structure affords bending of the wall at a juncture between the central domed structure and the generally rigid structure, and flexing of a portion of the domed structure so that its outer surface will temporarily change from convex to concave in response to moderate pressure applied (as by the thumb) generally centrally on the outer surface. The domed structure will then suddenly recover and return its outer surface from convex to concave a short time after removal of the pressure to afford (if its outer surface is positioned on a firm support surface) propulsion of the popper toy into the air.

BRIEF DESCRIPTION OF THE DRAWING

The popper toy will be further explained with reference to a specific embodiment thereof which is illustrated in the accompanying drawing wherein like numbers refer to like parts in the several views, and wherein.

DESCRIPTION OF THE PREFERRED EMBODIMENT

Figure 5:
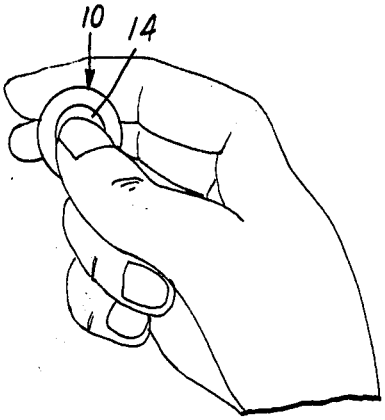
FIG. 5 is a perspective view illustrating manual deflection of the domed structure of the popper toy.

Referring now to the drawing there is illustrated a popper toy according to the present invention generally designated by the numeral 10. The popper toy comprises a thin generally dish shaped wall of flexible resilient polymeric material, which wall, in its normal condition (FIGS. 1 and 2), has a generally concave inner surface 12 and a generally convex outer surface 14. Both of the surfaces 12 and 14 may be printed with designs and/or messages, such as a four color design on the inner surface 12, and instructions for operation of the popper toy 10 on the outer surface 14.

Figure 1:
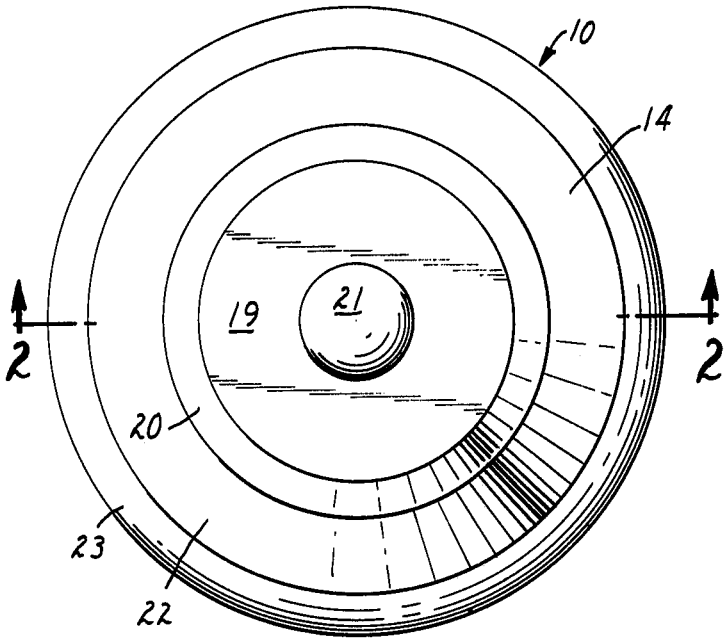
FIG. 1 is a plan view of a popper toy according to the present invention.
Figure 6:
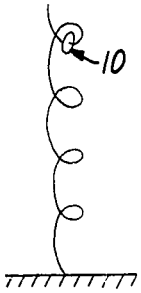
FIG. 6 is a view illustrating the action of the popper toy upon recovery of the domed structure against a firm surface.
Figure 2:
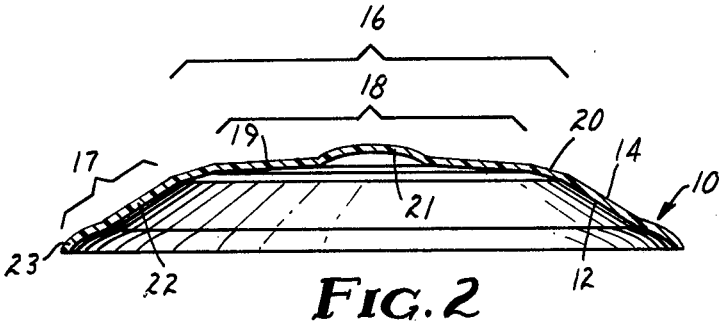
FIGS. 2, 3 and 4 are sectional views taken approximately along the line 2—2 of FIG. 2, which views illustrate three positions assumed by a domed structure defined by portions of the wall of the popper toy during deflection and recovery thereof.

As is best seen in FIGS. 1 and 2 the popper toy 10 comprises wall structure means for defining a central normally domed structure 16 surrounded by a generally rigid support structure 17. The domed structure 16 is adapted to deflect and temporarily change a portion of the outer surface 14 from generally convex to generally concave when pressure is applied centrally to the outer surface 14 (FIG. 3) and to then suddenly recover to its original shape (FIGS. 2 and 6) with a snap action a short time after the pressure is released so that, if the outer surface 14 is against a firm surface when the domed structure 16 recovers, the popper toy 10 will be propelled into the air.

The domed structure 16 comprises two portions, including a central portion 18 which is the portion that changes from generally convex to generally concave when pressure is applied to the outer surface 14, and a first hollow truncated conical ring-like portion 20 around the central portion 18. The ring-like wall portion 20 is deflected around its juncture with the rigid support structure 17 as pressure is applied to change the outer surface of the central portion 18 from generally convex to generally concave (FIG. 3), but does not substantially change its cross sectional contour as the pressure is applied. After the pressure is applied and released and before the central portion 18 returns from generally concave to generally convex (FIG. 4), the ring-like portion 20 returns almost to the same position it occupies when the outer surface of the central portion 18 is convex (FIG. 2), which position of the ring-like portion 20 seemingly promotes the subsequent sudden snap action recovery of the central portion 18.

Figure 3:
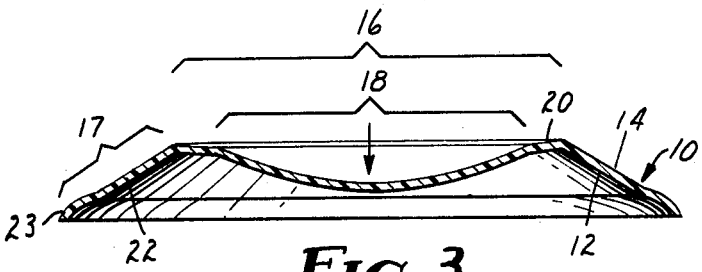
Figure 4:
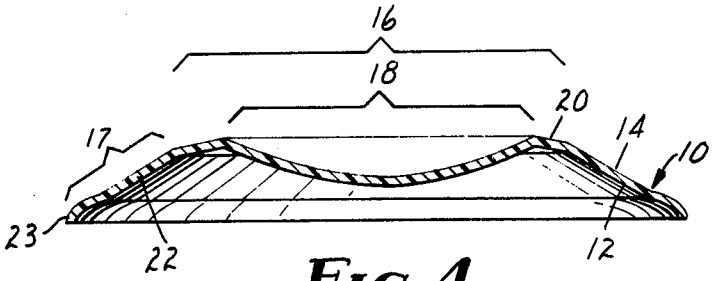

The central wall portion 18 preferably has two sub portions. These sub portions include an outer truncated hollow conical sub portion 19 and a central sub portion 21 which is arcuate in cross section. Both of the sub portions 19 and 21 form a fairly smooth convex arc along the outer surface 14 when the central wall portion is deflected as illustrated in FIGS. 3 and 4. The central sub portion 21 may be eliminated and the outer sub portion 19 made smoothly continuous across the center of the popper toy, however if this is done the height to which the popper toy will jump will be somewhat reduced.

The rigid support structure 17 comprises a second hollow truncated conical wall portion 22 with surfaces disposed at a substantially smaller angle than are the surfaces of the ring-like portion 20 to which it is joined, so that the second hollow truncated conical wall portion 22 will not deflect with the domed structure 16 and will define a definite bending line for the domed structure 16 between the hollow truncated conical wall portions 20 and 22.

Also included in the support structure 17 is a rim 23 of arcuate cross section on the edge of the second hollow truncated conical wall portion 22 opposite the ring-like portion 20. The rim 23 insures that the support structure will not splay, twist or bend transversely when it is supported only at two positions on opposite edges, as by a user's index and middle finger when pressure on the outer surface 14 is applied by the user's thumb (FIG. 5).

The following is a specific non-limiting example of material and dimensions for the popper toy 10 which provide a very suitable commercial embodiment thereof. The popper toy 10 is formed from a sheet of 0.020 thick white litho grade high impact styrene polymer such as that sold by A.B.G.Plastic Co. of Portage, Wisconsin. This sheet of styrene polymer is first printed in multi colors by conventional offset litho printing techniques to provide the designs and messages for a plurality of the popper toys. The sheet is then vacuum formed in a commercially available device such as the Ampac Model A3600 vacuum forming device by first preheating the sheet at about 350 to 400 degrees Fahrenheit for about 9 to 11 seconds and then applying about 20 to 25 inch pounds of vacuum to draw the sheet into a plurality of female dyes to form each popper toy in the shape illustrated in the drawing. The popper toys are then dye cut from the sheet on a separate machine. Each resultant popper toy 10 has an outer diameter of about 1⅜ inch and an axial overall height of about 0.23 inch. Its rim has an axial height of about 1/16 inch and is arcuate to an outer diameter of about 1.17 inch at its juncture with the second truncated conical wall shaped portion 22. The opposite surfaces of the second truncated conical shaped wall portion 22 are disposed at an included angle of about 114 degrees and provide a preferred diameter for maximum jumping height of about 0.918 inch at its juncture with the ring-like portion 20; although that diameter may be varied (by varying the angle mentioned) between ½ to 1 inch and still provide a usable popper toy. The first truncated conical shaped wall portion 20 of the domed structure 16 has surfaces disposed at about 142 degrees and extends inwardly to a diameter of about 43/64 inch at which the central portion 18 begins. The opposite surfaces of the outer sub portion 19 of the central structure are disposed at an included angle of about 160 degrees, and the central sub portion 21 of the central portion 18 has a diameter of about 0.2 inch and an axial height of about 0.006 inch. The material thickness remains about 0.02 inch at the rim 23, but is preferably thinned to about 0.016 to 0.018 inch across the domed structure 16. This thickness at the domed structure 16 requires that the central portion 18 be manually flexed several times in both directions between convex and concave before the central portion 18 will recover spontaneously in the manner described above. Once the proper snap action recovery of the central portion 18 begins, however, it will occur repeated for a very large number of times before the popper toy fails. Popper toys of this structure have been life tested for over 500 times without failure. When the material thickness at the domed structure 16 has been reduced to about 0.012 inch the popper toy does not require as many flexes of the central portion 18 before proper operation of the popper toy begins, but the life of the toy is significantly reduced.

Popper toys 10 of the preferred construction indicated above can repeatedly jump from a firm surface to a height of over 12 inches.

I claim:

1. A popper toy comprising a thin wall of flexible resilient polymeric material normally having a generally concave inner surface and a generally convex outer surface and comprising concentric edge connected wall portions including a central wall portion, a first hollow truncated conical shaped wall portion having opposite surfaces disposed at a first included angle around said central wall portion, a second hollow truncated conical shaped wall portion disposed around said first truncated conical shaped wall portion having opposite surfaces disposed at a second included angle substantially smaller than said first included angle, and a rim having an arcuate cross section around said second truncated conical shaped wall portion, said central wall portion and first truncated conical shaped wall portion being disposed to bend said wall at the juncture between said truncated conical shaped wall portions and flex to change the outer surface of said central portion from convex to concave in response to moderate thumb pressure applied generally centrally on said outer surface, and to cause snap action recovery of said central portion to return the outer surface from concave to convex a short time after removal of said thumb pressure to afford propulsion of said popper toy into the air, said rim and second hollow truncated conical shaped wall portion being disposed to provide a generally rigid support structure around said first hollow truncated conical shaped wall portion which support structure is adapted for engagement along opposite edges of said rim by the thumb and index finger during application of thumb pressure to said central portion and to restrict deflection and transverse bending upon application of finger pressure to said popper toy.

2. A popper toy according to claim 1, wherein said polymeric material is high impact styrene.

3. A popper toy according to claim 1, wherein said central wall portion includes a central sub portion which is arcuate in cross section and an outer truncated hollow conical shaped sub portion around said central sub portion.

4. A popper toy according to claim 1, wherein said material is styrene, said central wall portion and first truncated conical shaped wall portions have a thickness in the range of about 0.010 to 0.020 inch, and said first hollow truncated conical shaped wall portion has an outer diameter in the range of ½ to 1 inch.

5. A popper toy according to claim 4, wherein said wall has a diameter of about 1⅜ inch and an axial height of about 0.23 inch, said central wall portion has a thickness in the range of 0.016 to 0.018 inch and said first truncated conical shaped wall portion has a diameter of about 15/16 inch.

6. A popper toy comprising a thin wall of flexible resilient polymeric material normally having a convex outer surface and a concave inner surface with at least one of said surfaces bearing decorative multi color printing and comprising wall structure means for providing a central domed structure and a generally rigid support structure around said central domed structure, for affording bending of said wall at the juncture between said central domed structure and said rigid support structure and flexing of said central domed structure to change the outer surface of a part of said domed structure from convex to concave in response to moderate pressure applied generally centrally on said outer surface, and for causing snap action recovery of said central domed structure to return the outer surface from concave to convex a short time after removal of said pressure to afford propulsion of said popper toy into the air.

7. A popper toy according to claim 6, wherein said domed structure comprises a central wall portion adapted for said flexing to change the outer surface of a part of said domed structure from convex to concave, and a ring-like portion around said central wall portion, said ring-like portion being deflected around its juncture with said rigid support structure upon application of said moderate pressure.

8. A popper toy according to claim 7, wherein said central wall portion includes a central sub portion which is arcuate in cross section, and an outer sub portion around said central sub portion.

9. A popper toy according to claim 6, wherein said material is styrene, and said central domed structure has a thickness in the range of about 0.01 to 0.02 inch and an outer diameter in the range of about ½ to 1 inch.

10. A popper toy comprising a thin wall of flexible resilient styrene material normally having a convex outer surface and a concave inner surface and comprising wall structure means for providing a central domed structure having a thickness in the range of about 0.01 to 0.02 inch and an outer diameter in the range of about ½ to 1 inch and a generally rigid support structure around said central domed structure, for affording bending of said wall at the juncture between said central domed structure and said rigid support structure and flexing of said central domed structure to change the outer surface of a part of said domed structure from convex to concave in response to moderate pressure applied generally centrally on said outer surface, and for causing snap action recovery of said central domed structure to return the outer surface from concave to convex a short time after removal of said pressure to afford propulsion of said popper toy into the air.

* * * * *